United States Patent [19]

Beck

[11] 3,975,467

[45] Aug. 17, 1976

[54] BASEBOARD DRAINAGE SYSTEM

[76] Inventor: Nevitt S. Beck, 260 Bonnett St. SW., North Canton, Ohio 44720

[22] Filed: July 28, 1975

[21] Appl. No.: 599,788

[52] U.S. Cl. ..... 261/30; 52/287; 52/290; 52/303

[51] Int. Cl.[2] ..... E04B 1/70; E04F 17/00

[58] Field of Search ..... 261/30, 119 R; 52/302, 52/303, 169, 198, 287, 288, 290, 242

[56] References Cited

UNITED STATES PATENTS

| | | | |
|---|---|---|---|
| 2,703,002 | 3/1955 | Suskind | 52/302 |
| 2,717,513 | 9/1955 | Smart | 52/303 |
| 2,811,850 | 11/1957 | Clary | 52/303 |
| 3,304,672 | 2/1967 | Bakke | 52/287 |
| 3,332,185 | 7/1967 | Adams | 52/303 |
| 3,344,569 | 10/1967 | Cotten | 52/303 |
| 3,413,769 | 12/1968 | Hoyt | 52/287 |

*Primary Examiner*—Tim R. Miles
*Assistant Examiner*—Gregory N. Clements
*Attorney, Agent, or Firm*—Frease & Bishop

[57] ABSTRACT

A drainage system preferably to eliminate wet and damp basements which is formed from an inexpensive, easily assembled pair of sheet metal members. A strip of waterproof sealing material is placed on the basement floor extending along the basement wall with one of the sheet metal members having an L-shaped configuration being mounted on top of the strip of sealing material and secured to the floor by fasteners. An upstanding leg flange of the L-shaped member is spaced from the wall and forms a drainage channel with the wall and floor. The second sheet metal member is removably mounted on the top edge of the upstanding leg member and extends generally horizontally across the top of the drainage channel and engages the wall to form a removable top closure for the channel. A plurality of holes are drilled through the basement wall adjacent the basement floor to permit outside water to readily flow through the wall and into the drainage channel. A plurality of air passage ducts may be mounted on the basement wall and communicate with the drainage channel. A blower circulates air from within the basement through the air ducts and drainage channel to the outside air to remove moisture from the basement and drainage channel.

14 Claims, 5 Drawing Figures

BASEBOARD DRAINAGE SYSTEM

BACKGROUND OF THE INVENTION

1. Field of the Invention

The invention relates to drainage systems and in particular to drainage systems adapted to be installed in the interior of a basement to eliminate outside surface water from flowing into the basement. More particularly, the invention relates to a drainage system readily and inexpensively assembled from a pair of sheet metal members which form a drainage channel with the basement wall and floor together with air ducts for circulating air through the drainage channel for removing moisture from the drainage channel.

2. Description of the Prior Art

Various systems and constructions have been devised in an attempt to eliminate outside surface water from seeping through basement walls and entering a basement to enable the basement to remain in a dry condition thereby being usable for storage and other activities. Heretofore, the reduction or elimination of such surface water has been accomplished by the installation of drain tiles adjacent the basement footers exterior of the basement walls. Such installations require considerable digging and earth removal, which is quite expensive for an existing home or structure. Thus, a need existed for a drainage system which can be installed on the interior of the basement at a more reasonable cost to eliminate wet basements.

Several systems have been developed such as shown in U.S. Pat. Nos. 2,157,290, 2,948,993 and 3,287,866, wherein drainage tiles and conduits are installed adjacent the building footers below the basement floor. Again such systems require concrete removal, digging, and installation of new concrete after the drainage tiles are installed which increases considerably the cost of such systems. Other types of drainage systems, such as shown in U.S. Pat. Nos. 1,131,437 and 3,426,487 use the hollow spaces formed in the building blocks of the exterior walls for removal of water and moisture from the building.

More recently, drainage systems have been devised which are installed in a basement adjacent the basement wall and floor which eliminates extensive digging, concrete work and the like. Examples of such systems are shown in U.S. Pat. Nos. 3,304,672, 3,332,185, 3,344,569 and 3,413,769. Another type of system in common use today, similar to those systems shown in the just listed patents, is the formation of a baseboard drain system by a plurality of sections of L-shaped ceramic tiles. The tiles are assembled together and mounted on the floor adjacent the basement wall by mortar.

Such systems have proved relatively successful in reducing and eliminating wet basements. Some of these systems are formed of plastic material which may be susceptive to cracking and breakage if accidentally struck by a hard object. Likewise, it is desirable to be able to gain access to the interior of the drainage channel formed by such baseboard systems for cleaning and sanitizing the channel area to prevent build-up of bacteria and odor. Many systems do not permit easy access to the channel interior without disassembling a major portion of the system components. Also, these prior systems have no means for removing moisture from within the drain channel which remains after the main water has drained away. Thus, an undesirable odor, musty smell and condition may arise which is unsatisfactory.

The main disadvantage of existing and past baseboard-type drainage systems is the cost, both for material and labor. Ceramic tile installations are costly both for the material and the concrete work required for their installation. Likewise, plastic conduit forming material is relatively expensive in order to be of sufficient thickness to reduce breakage. Such plastic constructions require special designs and molding procedures to obtain the desired shape which also increases the material cost.

Thus, the need has existed for a baseboard drainage system which is constructed of inexpensive, readily available material, and which can be installed and maintained with a minimum of labor and expense.

SUMMARY OF THE INVENTION

Objectives of the invention include providing a baseboard drainage system which is formed of inexpensive, readily available sheet metal material, which can be transported to a job site in compact coiled form and custom-fitted to the particular shape and size of a room rapidly and inexpensively at the job site; providing a baseboard drainage system which can be formed as a continuous unit, preferably exteriorly of a basement, folded and then transported to the basement and unfolded just prior to installation; providing a baseboard drainage system which includes means for circulating air through the drainage channel to remove moisture therefrom to prevent a damp and musty condition from developing, and in which such a circulating air system is formed of the same inexpensive sheet metal material as is the water drainage system; providing such a drainage system, a top portion of which can be removed quickly and easily permitting access to the interior of the drainage channel for cleaning and sanitizing thereof; and providing a baseboard drainage system which is inexpensive to manufacture and install, sturdy and durable in use, which provides a pleasing appearance, and which eliminates difficulties heretofore encountered, achieves the objectives indicated, and solves problems and satisfies needs existing in the art.

These objectives and advantages are obtained by the baseboard drainage system of the invention for use in an area having at least a wall and adjoining floor, the general nature of which may be stated as including a generally L-shaped sheet metal member having a base flange and an upstanding leg flange, the base flange being adapted to be mounted on the floor adjacent the wall; sealing means adapted to seal the base flange with respect to the floor; fastening means adapted to secure the base leg flange to the floor with the upstanding leg flange being spaced from the wall and forming a drainage channel with the wall and floor; sheet metal closure means removably mounted on the upstanding leg flange and extending across the drainage channel and engageable with the wall to form a removable top closure for the drainage channel; and air passage means communicating with the drainage channel for circulating air through the drainage channel.

BRIEF DESCRIPTION OF THE DRAWING

A preferred embodiment of the invention — illustrative of the best mode in which applicant has contemplated applying the principles — is set forth in the following description and shown in the accompanying drawing and is particulary and distinctly pointed out and set forth in the appended claims.

Similar numerals refer to similar parts throughout the drawing.

DESCRIPTION OF THE PREFERRED EMBODIMENT

Figure 1:
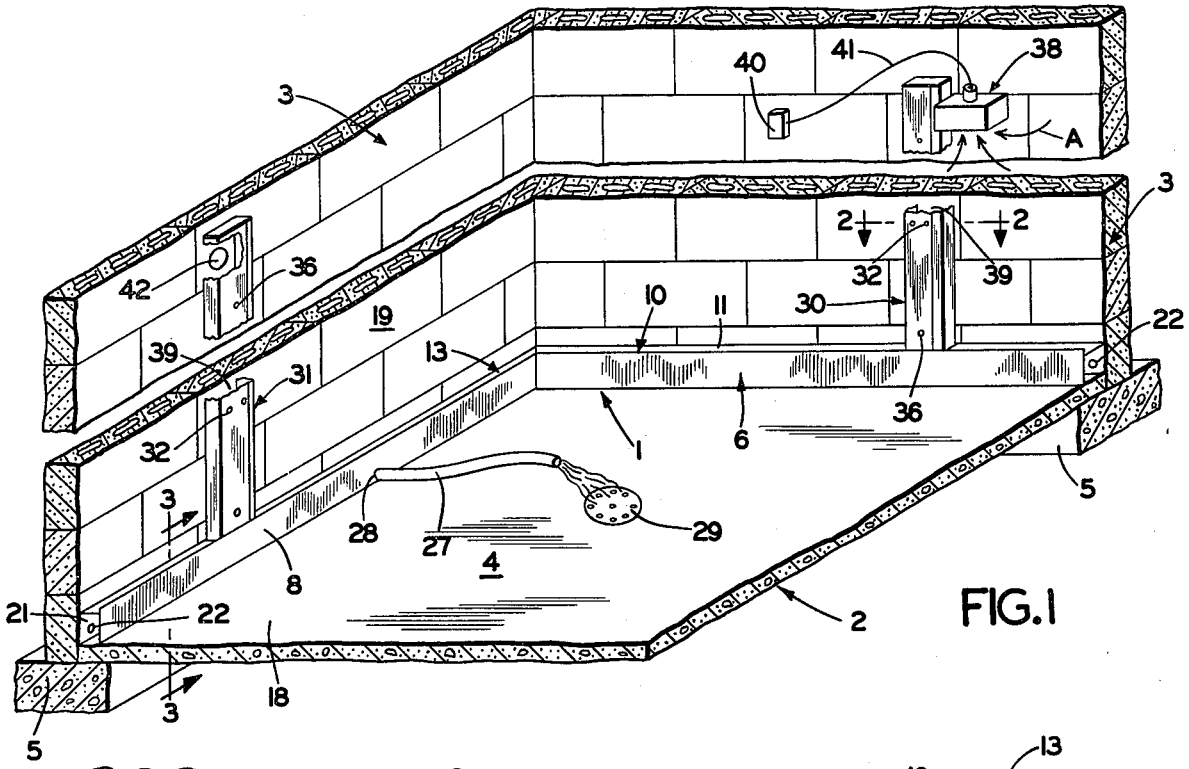
FIG. 1 is a fragmentary, generally diagrammatic perspective view of a corner section of a basement showing portions of the improved baseboard drainage system mounted therein.

FIG. 1 illustrates the improved baseboard drainage system indicated generally at 1, mounted within a corner section of a basement 2, and shown in general diagrammatic fashion. Basement 2 is of a usual construction having concrete block walls 3, concrete floor 4 and concrete wall footers 5. Although the improved system is shown and described for use in a basement, drainsystem 1 may be used in any room or area in which water flows through a wall and onto the floor, without departing from the concept of the invention.

Figure 3:
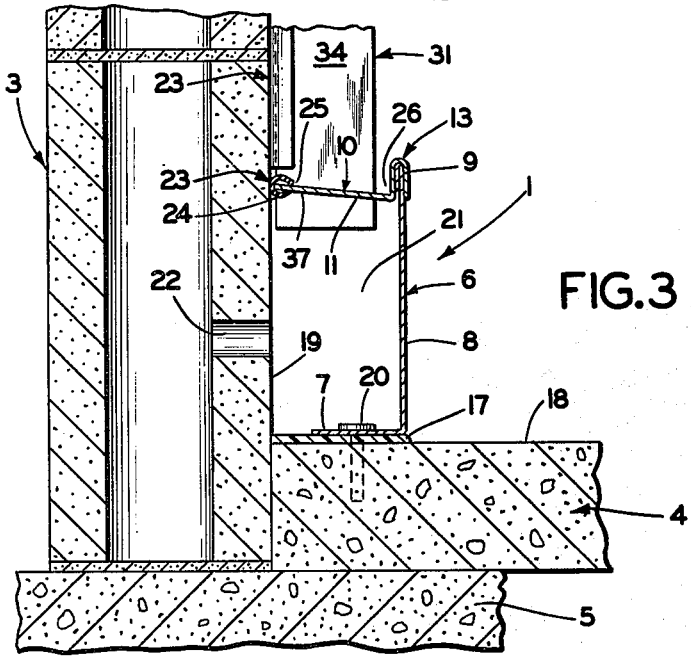
FIG. 3 is an enlarged fragmentary sectional view taken on line 3—3, FIG. 1.

In accordance with the invention, the improved drainage system 1 includes an L-shaped sheet metal member 6 and a top closure member 10 (FIG. 3). Member 6 has a base flange 7 and an upstanding leg flange 8, preferably larger than base flange 7. Members 6 and 10 are formed inexpensively and economically from sheet metal of the type commonly used for outside drain gutters and spoutings. Members 6 and 10 preferably are custom-formed from a flat strip of such sheet metal material which is supplied from a roll coil of such material by a portable metal forming machine (not shown) which is easily transported to a job site.

Figure 4:
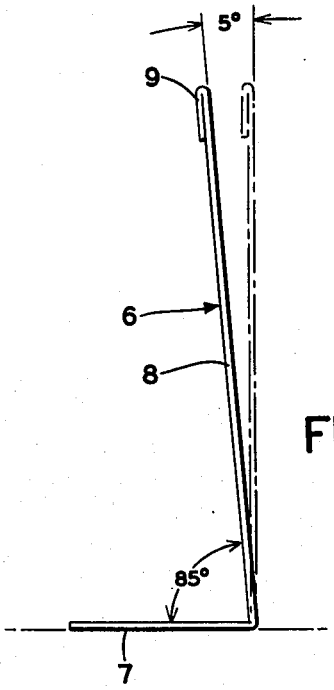
FIG. 4 is a further enlarged elevational view of the L-shaped sheet metal member of the improved baseboard drainage system.

Members 6 and 10 preferably are of a single sheet thickness with the top edge of leg flange 8 terminating in a reversely bent double thickness flange 9. Member 6 preferably is formed as shown in FIG. 4 with upstanding leg flange 8 joining base flange 7 at an acute angle (an angle of 85° being illustrated), the purpose of which is discussed below. Top closure member 10 includes a generally horizontal, planar portion 11 terminating at one end in a straight side edge 12 and at the other end in an inverted, vertically extending U-shaped flange 13. Flange 13 has a pair of generally vertically extending parallel portions 14 and 15 forming a slot 16 therebetween. Planar portion 11 also forms an acute angle of approximately 85° with U-shaped flange portion 14 as does base flange 7 and leg flange 8.

A strip of waterproof sealing material 17 (FIG. 3), such as the type of material sold under the name of "Miracle Seal" by Revere Chemical Corporation of Solon, O., is placed on the top surface 18 of floor 4 along and adjacent to the interior surface 19 of basement wall 3. Base flange 7 of L-shaped member 6 is mounted on sealing strip 17 and is secured to floor 4 by a plurality of bolts 20 or other fastening means which extend through base flange 7 and into the concrete.

L-shaped member 6 when in the installed position of FIG. 3 forms a drainage channel 21 with wall 3 and floor 4 into which seepage surface water will flow. A plurality of holes 22 preferably are drilled through the interior portions of walls 3 at spaced intervals adjacent floor 4 to relieve hydrostatic pressure which such seepage water may exert on the wall, and to enable the water to flow into channel 21 instead of through small cracks and porous locations in the wall above improved drainage system 1.

Top closure member 10 next is slidably mounted on L-shaped member 6 by inserting edge flange 9 into U-shaped slot 16 of member 10 to form a generally slip-fit friction connection therebetween. The width of slot 16 preferably is equal to the double thickness of edge flange 9. A strip of rubber 23, vinyl or similar sealing material is mounted on edge 12 of closure member 10 to provide a seal with wall 3 when in assembled position. Sealing strip 23 may be a rubber tube 24 formed with a longitudinally extending slit 25 (FIG. 3).

L-shaped member 6 is installed a predetermined distance from wall 3 (a distance approximately equal to the length of planar portion 11 of top closure 10) so that leg flange 8 is in a general vertical position after slidably mounting top closure member 10 on leg flange 8 as shown in FIG. 3. The approximately 5° preset angle from vertical of leg flange 8 biases flange 8 toward wall 3 when in the assembled position to force rubber strip 23 into sealing engagement with wall 3.

The 5° preset slope angle of planar portion 11 of top closure 10 enables any seepage water which my enter the basement from above drainage assembly 1 to flow downwardly along closure portion 11 toward the center of the basement and collect in an external secondary drain channel 26 adjacent U-shaped flange 13 (FIG. 3). It is anticipated that only a very small amount of water will flow through wall 3 above assembly 1 due to the formation of drain holes 22 in wall 3.

Preferably in a usual installation, the peripheral dimensions of basement 2 will be obtained, with a continuous L-shaped member 6 and a continuous top closure member 10 being paved out and formed on a portable metal forming machine, in length generally equal to the total perimeter of the basement area to be protected. Generally 45° cuts then will be made in the continuous members at the corner locations. The members can be folded at these cuts to provide a convenient length for carrying the formed members 6 and 10 into the basement from a truck or similar vehicle in which the metal forming machine may be located.

A drain hose 27 may be attached at 28 at a predetermined location on leg flange 8 and extend between and communicate with drain channel 21 and a basement drain opening 29 (FIG. 1). Hose 27 provides a means of removing water rapidly from channel 21 when large amounts of water flow through drain holes 22 as during a heavy rain. Some installations may not require exterior drain hose 27 where the amount of water entering channel 21 is relatively minor and will evaporate quickly without any exit opening.

Another important feature of drainage system 1 is the providing of means to circulate air through drainage channel 21 to accelerate the evaporation of water and moisture within the channel to prevent odor and mildew from forming therein. A plurality of vertically extending air ducts, at least an input duct 30 and an exhaust duct 31 (as shown in FIG. 1) communicate with drainage system 1 and extend upwardly therefrom.

Figure 2:
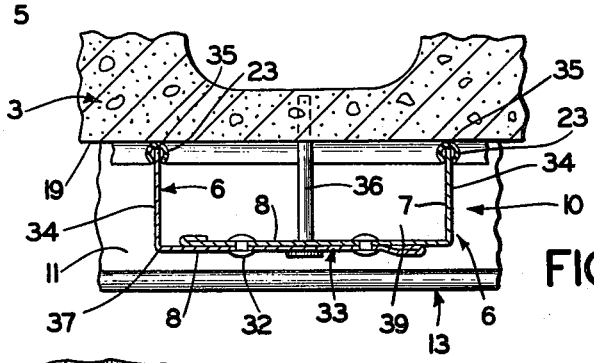
FIG. 2 is an enlarged sectional view taken on line 2—2, FIG. 1.
Figure 5:
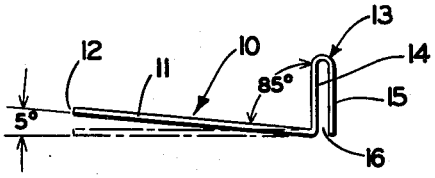
FIG. 5 is an elevational view showing the top closure sheet metal member of the baseboard drainage system which is adapted to be removably mounted on the L-shaped member shown in FIG. 4.

Ducts 30 and 31 are similar, each being formed by a pair of L-shaped sheet metal members 6, which are assembled in overlapping relationship as shown in FIG. 2. Leg flanges 8 are placed in overlapping position and are secured together by rivets 32, self-threading sheet metal screws or the like, to provide a web wall 33 of a U-shaped duct together with base flanges 7 which form the side legs 34 of the duct.

Rubber strips 23 are placed on free edges 35 of duct side legs 34 to provide a seal with surface 19 of wall 3. Ducts 30 and 31 are mounted on wall 3 by rivets 36 or similar fasteners. Ducts 30 and 31 preferably extend partially through openings 37 formed in planar portion 11 of closure member 10 (FIG.3) to communicate with drain channel 21.

A blower unit 38 is mounted on wall 3 adjacent the top of input duct 30 and communicates with the interior of duct 30. Blower 38 sucks air (Arrow A, FIG. 1) into air passages 39 formed by ducts 30 and 31 when energized by a humidistat control unit 40 connected to blower 38 by line 41. The air flows downwardly in input air duct 30, through drainage channel 21, then upwardly through exhaust duct 31, and into the outside air through an exhaust opening 42 formed in wall 3.

This circulating air removes damp air and moisture from within the basement as well as from within drainage channel 21 preventing accumulation of moisture and the formation of mildew. Additional input and exhaust ducts similar to duct 30 and 31 may be mounted at other locations in the basement and communicate with drainage system 1 if desired.

Accordingly, the improved baseboard drainage system permits the interior of drain channel 21 to be cleaned out and sanitized if desired, by the easy and fast removal of top closure member 10 without the need of removing clips, bolts or other attaching device; provides a completely enclosed drainage channel without the need of mounting the brackets or other devices being mounted on the basement walls as in other systems, and in which the system components can be installed without the use of mortar or other expensive and laborious attaching means; provides a drainage system which may have humidity control means incorporated therein which accelerates removal of moisture from within the basement and the drain channel, and which functions as a dehumidifier preventing mildew and bacteria build-up; provides a drainage system which is constructed easily and inexpensively of sheet metal members which can be formed continuously from coiled sheet metal stock at the job site; provides a drainage system in which rubber sealing strips 23 provide an air seal for drainage channel 21 and air ducts 30 and 31 to retain the major portion of the humidity control circulating air flow within the channel and ducts, and in which sealing strip 17 seals existing and future minor cracks in the basement floor preventing leakage of water from channel 21; and provides structures and arrangements which are very simplified, which eliminates difficulties existing in the art, and which achieves the stated objectives and solves problems that have existed in the art.

In the foregoing description, certain terms have been used for brevity, clearness and understanding, but no unnecessary limitations are to be implied therefrom beyond the requirements of the prior art, because such words are used for descriptive purposes herein and are intended to be broadly construed.

Moreover, the embodiment of the improved construction illustrated and described herein is by way of example, and the scope of the present invention is not limited to the exact details of the construction shown or described.

Having now described the features, discoveries, and principles of the invention, the manner in which the improved baseboard drainage system is constructed, assembled and operated, the characteristics of the new construction, and the advantageous, new and useful results obtained; the new and useful structures, devices, elements, arrangements, parts, and combinations are set forth in the appended claims.

I claim:

1. A drainage system for use in an area having at least a wall and adjoining floor including;

a. a generally L-shaped sheet metal member having a base flange and an upstanding leg flange having orifice means therein; said member being adapted to be mounted on the floor adjacent the wall of the area;

b. sealing means adapted to seal the base flange with respect to the floor;

c. fastening means adapted to secure the base flange to the floor, with the upstanding leg flange being spaced from the wall to form a drainage channel with said wall and floor; and d. top closure means removably mounted on the upstanding leg flange and extending across the drainage channel and engageable with the wall to form a removable top closure for the drainage channel.

2. The system defined in claim 1 in which spaced input and exhaust air passage means communicate with the drainage channel; in which blower means communicates with the input air passage means and circulates air through the drainage channel and exhaust air passage means to assist in evaporating moisture within the drainage channel.

3. The system defined in claim 2 in which the air passage means each includes a sheet metal duct adapted to extend vertically along the wall upwardly from the drainage channel; and in which each of said ducts comprises a pair of L-shaped sheet metal members joined in overlapping relationship to provide the ducts with U-shaped configurations.

4. The system defined in claim 3 in which the L-shaped sheet metal members of the air passage means ducts are identical to the L-shaped sheet metal member which form the drainage channel.

5. The system defined in claim 3 in which the top closure means of the drainage channel is formed with opening means; and in which the air passage means ducts communicate with the drainage channel through said opening means.

6. The system defined in claim 1 in which the upstanding leg flange terminates in a reversely bent top edge; in which the closure means includes a generally planar sheet metal strip terminating in first and second side edges, with said second edge being formed with inverted U-shaped flange means extending upwardly from the planar strip; and in which the upstanding leg flange top edge is slip-fitted within the closure means U-shaped flange means to removably mount the closure means on the L-shaped sheet metal member.

7. The system defined in claim 6 in which the planar strip slopes upwardly from the inverted U-shaped flange means toward the wall and forms an exterior secondary drain area at the junction of said planar strip and flange means.

8. The system defined in claim 1 in which the upstanding leg flange forms an acute angle with the base flange in unassembled condition; and in which said leg flange is generally perpendicular with the base flange in assembled condition and biases the top closure means towards the wall.

9. The system defined in claim 1 in which the top closure means has a wall engaging edge; and in which sealing means is mounted on said edge to provide a seal when engaged with a wall.

10. A basement drainage system in combination with a basement wall and floor including:

a. an elongated generally L-shaped sheet metal member having a base flange and an upstanding leg flange;

b. a strip of sealing material extending along the wall and overlying the basement floor adjacent said wall;

c. fastening means securing the base flange of the L-shaped member to the floor with the strip of sealing material being interposed between the floor and said base flange providing a generally watertight seal therebetween;

d. the upstanding leg flange being spaced a predetermined distance from the wall and forming a drainage channel with said wall and base flange;

e. a sheet metal top closure member removably mounted on the leg flange and extending across the drainage channel and engaging the wall to form a removable top closure for the drainage channel; and f. opening means formed in the wall communicating with the drainage channel whereby seepage water may flow through said opening means and into the drainage channel.

11. The system defined in claim 10 in which a plurality of duct means are mounted on the wall and communicate with the drainage channel; in which blower means is operatively connected to one of the duct means and draws air from within the basement through said one duct means, through the channel means and through a second duct means; and in which an exhaust opening is formed in the wall and communicates with said second duct means for exhausting the air from the second duct means through the wall to the outside.

12. The system defined in claim 10 in which drain opening means is formed in the basement floor; and in which drain conduit means extends between and communicates with the basement floor drain opening means and the drainage channel.

13. The system defined in claim 10 in which the upstanding leg flange terminates in a top edge; in which the top closure member includes a main panel portion and an integral end portion; and in which the upstanding leg flange top edge slidably engages the main panel end portion to removably mount said closure member on said leg flange.

14. The system defined in claim 13 in which the leg flange top edge is provided with a thickened end portion; in which the integral end portion of the top closure member is provided with slot means; and in which said thickened end portion of said leg flange is slidably engaged within said slot means to removably mount said closure member on said leg flange.

* * * * *